United States Patent [19]

Schwarz

[11] Patent Number: 5,007,583

[45] Date of Patent: Apr. 16, 1991

[54] DEVICE FOR ACCOMODATING EXPANSION IN FLUID CIRCULATION SYSTEMS

[75] Inventor: Anton Schwarz, Seefeld, Austria

[73] Assignee: A. Schwarz & Co., Seefeld, Austria

[21] Appl. No.: 314,056

[22] PCT Filed: May 4, 1988

[86] PCT No.: PCT/AT88/00025

§ 371 Date: Jan. 4, 1989

§ 102(e) Date: Jan. 4, 1989

[87] PCT Pub. No.: WO88/08943

PCT Pub. Date: Nov. 17, 1988

[30] Foreign Application Priority Data

May 5, 1987 [AT] Austria ..... 1118/87
Jun. 2, 1987 [AT] Austria ..... 1400/87

[51] Int. Cl.[5] ..... F24D 3/10
[52] U.S. Cl. ..... 237/66; 237/59

[58] Field of Search ..... 237/66, 1 R, 81, 8 R, 237/56, 59

[56] References Cited

U.S. PATENT DOCUMENTS 4,013,221 3/1977 Eder ..... 237/66

FOREIGN PATENT DOCUMENTS 177431 12/1961 Sweden ..... 237/66

*Primary Examiner*—Henry A. Bennet
*Attorney, Agent, or Firm*—Notaro & Michalos

[57] ABSTRACT

Device for expansion transfer in liquid cycle systems, in particular for heating installations, comprising a heating boiler (1), a liquid line (2, 2'), radiators (3) and an expansion vessel (4) at atmospheric pressure. The expansion vessel (4) is connected to the liquid line (2) of the heating installation through an inlet line (5), an outlet line (6), an overflow valve (7) which can be adjusted according to the operating pressure of the installation, and a continuously operating circulating pump (9).

19 Claims, 1 Drawing Sheet

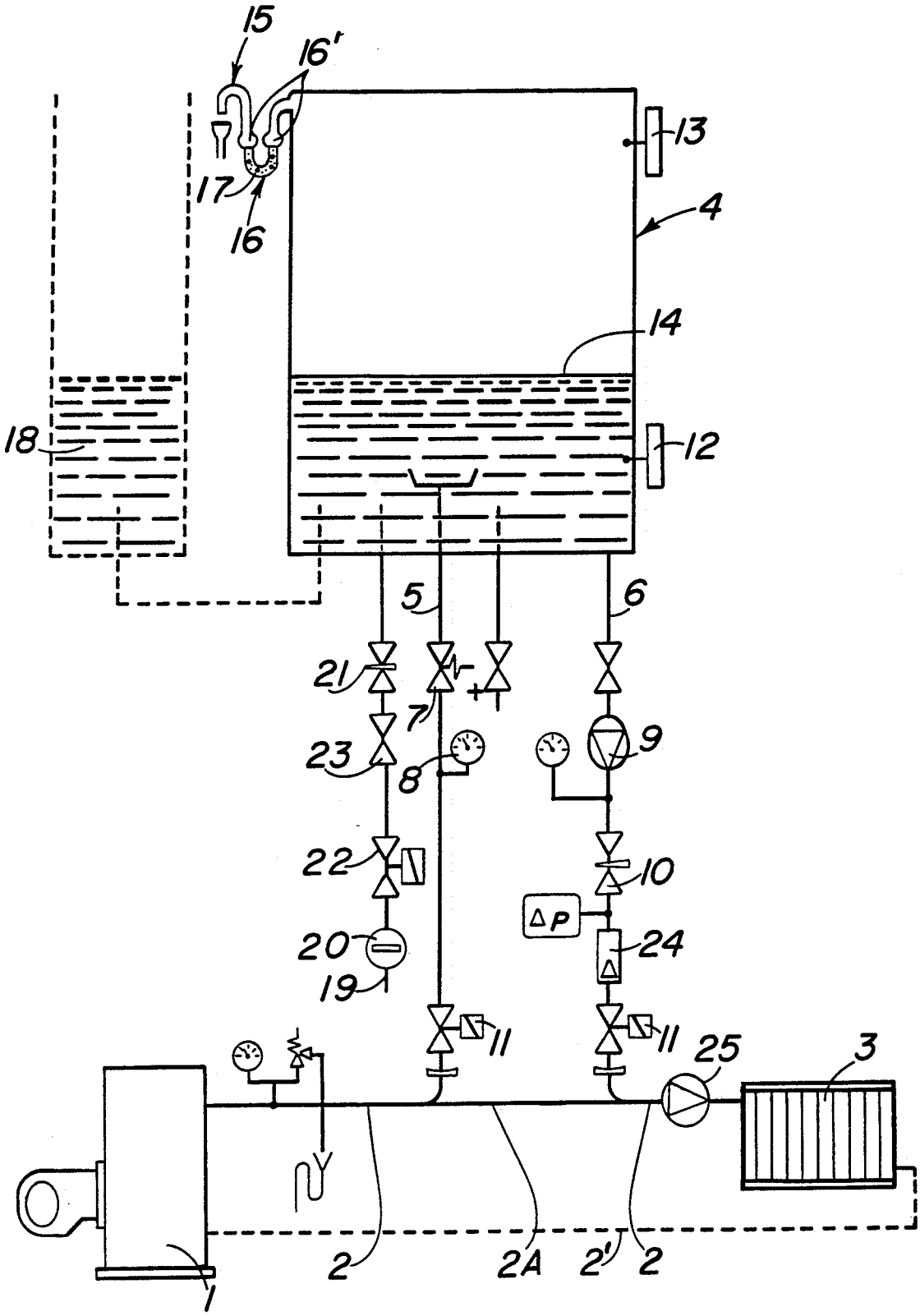
15
16'
17
16
13
4
14
18
12
5
6
21
7
23
8
9
22
10
ΔP
20
24
19
11
11
25
3
2
2A
2'
2
1

DEVICE FOR ACCOMODATING EXPANSION IN FLUID CIRCULATION SYSTEMS

FIELD AND BACKGROUND OF THE INVENTION

The invention relates to a device for accommodating expansion absorption in fluid circulation systems, in particular of heating or cooling installations, having at least one expansion vessel preferably in gas exchange with the atmosphere, into which liquid from the fluid circulation system is received and from which liquid is returned to the fluid circulation system via a pressure pump. An overflow valve which is adjustable to the operating pressure of the installation is provided in one conduit of the expansion vessel, so that a lower pressure prevails in the expansion vessel than in the fluid circulation system.

It is known that in heating installations, due to the heating or cooling of the heating fluid (water), a volume change occurs. Upon heating, the additional volume must be taken out of the fluid circulation, and upon cooling, returned into the fluid circulation again. In such heating installations it is known practice to transfer the excess heating fluid resulting from the thermal expansion into an open expansion vessel and upon cooling to supply heating fluid to the fluid circulation again via a pump.

Further also closed expansion vessels are known for this purpose. In this connection it is current practice to open a solenoid valve when a certain positive pressure is reached in the fluid circulation and to transfer the heating fluid from the circulation into the expansion vessel. When the pressure drops in the installation, the forcing pump is turned on and heating fluid is pumped from the expansion vessel into the fluid circulation. An example of such an installation can be seen in German patent document DE-A1-2,516,424. By this intermittent removal from and return of heating fluid into the fluid circulation considerable pressure fluctuations occur in the installation. Similar conditions appear also in cooling installations.

SUMMARY OF THE INVENTION

It is, therefore, the object of the invention to improve a device of the initially mentioned kind to the effect that the pressure compensation occurs smoothly and practically without pressure fluctuations in the fluid circulation system.

According to the invention, this is achieved in that the expansion vessel is connected to the fluid circulation system via separate inflow and outflow conduits and that in the outflow conduit from the expansion vessel a continuously running forcing and circulating pump is arranged.

The forcing and circulating pump continuously conveys liquid from the expansion vessel into the circulation system and, if correctly dimensioned, provides for maintaining the operating pressure in the circulation system to which the overflow valve in the inflow conduit to the expansion vessel is adjusted. Under normal operation at least a partial stream of the circulation fluid flows continuously through the overflow valve or through the expansion vessel. During the heating phase of the circulation fluid temporarily more fluid passes through the overflow valve into the expansion vessel than is conveyed from the latter by the forcing and circulating pump. This causes the liquid level in the expansion vessel to rise. In the cooling phase of the circulation fluid, conversely, more liquid is conveyed from the expansion vessel into the circulation system than flows into the expansion vessel via the overflow valve. The liquid level in the expansion vessel falls again. All this takes place practically without fluctuations of the operating pressure in the circulation system. The quantity of water delivered by the pump determines the flow through the valve. The pressure circulation need not be monitored.

In the device according to the invention a complex control technology for the control and monitoring of the installation can be dispensed with, and also there will be no wear and noise as is the case with the relatively frequent switching of solenoid valves and pumps operating intermittently.

It is possible to conduct only a partial stream of the system fluid (heating fluid) via the expansion vessel or, in particular for relatively small heating installations, to conduct the entire fluid stream via the inflow conduit, the expansion vessel, and the outflow conduit. In the latter case, the forcing and circulating pump disposed in the outflow conduit of the expansion vessel can take over also the function of the system circulating pump, so that an additional system circulating pump in the fluid circulation system is unnecessary.

A variant of the invention provides that at least one additional expansion vessel is connected to the expansion vessel. This avoids having to make expansion vessels of different size and volume for various system sizes. It suffices to produce an expansion vessel in a standard size, to which then further supplementary expansion vessels are connected in the case of larger installations. As these supplementary expansion vessels have no pumps or valves, the costs can be kept low.

The overflow valve in the inflow conduit to the expansion vessel produces the effect (in conjunction with the continuously running pump in the outflow conduit of the expansion vessel) that the flow direction before the overflow valve (that is, in the fluid circulation system) an operating pressure prevails to which the overflow valve is adjusted. In the flow direction behind the overflow valve, however (that is, in the expansion vessel) a pressure which is lower than the operating pressure of the installation prevails. For an open expansion vessel, i.e. one in gas exchange with the atmosphere, this is practically atmospheric pressure. This results in a further advantage of the device according to the invention, for—since in the fluid entering the expansion vessel a pressure drop takes place—gases contained in the circulation fluid can escape (Henry's law), and this not only occasionally, but continuously due to the feature of the invention whereby at least a partial stream of the system or circulation fluid is conducted through the expansion vessel continuously. Thus also the oxygen content of the heating fluid of a heating installation operated with the device according to the invention is considerably lower as compared with a conventional heating installation through concomitant elimination of the oxygen by degassing. If—as is provided preferably—the expansion vessel is in gas exchange with the atmosphere, the liquid surface in the expansion vessel may be covered by a float, to inhibit re-absorption of oxygen from the atmosphere. Alternatively the oxygen absorption may be reduced by a (preferably biodegradable) tarrier liquid above the water level. In an advantageous embodiment of the invention this is done in that the expansion vessel has near the gas outlet a siphon filled with a barrier fluid, for example oil.

BRIEF DESCRIPTION OF THE DRAWINGS

The only FIGURE in the application is a block diagram of the device for accommodating expansion in a fluid circulation system, in accordance with the present invention.

DESCRIPTION OF THE PREFERRED EMBODIMENT

The circulation system of a heating installation consists of the boiler 1, fluid conduits 2 (forward flow) and 2' (return flow) and heating elements (e.g. radiators) 3. The fluid circulation is maintained (or supported) by a system circulating pump 25. As the heating or circulation fluid, preferably filtered and softened tap water is used. Further an expansion vessel 4 is provided, which communicates via an inflow conduit 5 and an outflow conduit 6 with the forward conduit 2 of the installation. The connections of the inflow conduit 5 and of the outflow conduit 6 in the forward conduit 2 are arranged relatively close behind the boiler 1, in order to utilize the thermal degassing. This type of connection is suitable above all for water temperatures to about 90° C. For higher operating temperatures, it is better to make the connection of the inflow conduit 5 and of the outflow conduit 6 in the return conduit 2'. For smaller installations also the entire fluid stream may be conducted via the expansion vessel 4, the connecting line 2A between inflow conduit 5 and outflow conduit 6 being then unnecessary.

An overflow valve 7 is connected in the inflow conduit 5, which is adjustable to the system pressure. The actual pressure of the heating installation can be read from a pressure gauge 8. Normally a positive pressure of at least 1.5 bar prevails in the fluid circulation system in heating installations (depending on the height of the building. A continuously operating forcing and circulating pump 9 is connect in the outflow conduit 6. Pump 9 is followed in the flow direction by a quantity regulating valve 10 as well as by a flowmeter 24.

Further a solenoid valve 11 is provided both in the inflow conduit 5 and in the outflow conduit 6. (In the outflow conduit 6 this may also be a check valve). The expansion vessel 4 contains a lower level regulator 12 for operating a fresh water resupply mechanism (19 to 23) and an upper level regulator 13 to secure the outlet of the expansion vessel (at 15). If the water level 14 exceeds the height of the level regulator 13, the solenoid valves 11 are closed and the expansion vessel 4 is separated from the circulation of the installation. Via the level regulator 12, 13 also the heat generator (burner) can be turned off. Further, by a pressure monitor (e.g. by a pressostat) the expansion vessel 4 and the heat generator can be turned off in case of positive or negative pressure in the installation.

The gas outlet 15 of the expansion vessel 4 is provided with a siphon 16 filled with a barrier liquid 17. Both legs of the siphon 16 have zones 16' of enlarged cross section, to prevent outflow of barrier liquid in case of slight pressure fluctuations.

Shown in dashed lines is a supplementary expansion vessel 18, which can be connected to the expansion vessel 4 if necessary.

Conduit 19 is an inflow conduit for fresh water. Fresh water is pumped into the expansion vessel 4 when the water level 14 falls below the level of the lower level regulator 12. The fresh water inflow conduit 19 is provided with a water meter 20, a solenoid valve 22, a pipe divider 23, and a quantity regulating valve 21. Alternatively the fresh water inflow conduit may be connected elsewhere on the expansion vessel 4. Besides, an "automatic" fresh water resupply (which controls the solenoid valve 22 via the level regulator 12) need not necessarily be provided.

If (in smaller installations) the full liquid stream of the circulation system is guided by way of the expansion vessel 4, the separate system circulating pump 23 may be eliminated, because the forcing and circulating pump 9 operates continuously in the outflow conduit 6 and therefore can take over also the function of the system circulating pump.

The essential feature of the device according to the invention is that in continuous flow at least a partial stream of the heating fluid (heating water) is conducted through the expansion vessel which is connected via the inflow conduit 5 and the outflow conduit 6 to the fluid conduit (forward flow line 2 or return flow line 2') of the installation.

At a given operating pressure of the heating installation, heating fluid flows continuously via the overflow valve 7 into the expansion vessel 4, and the return of the heating fluid from the expansion vessel 4 into the circulation system or into the fluid line 2 occurs continuously, since the circulating pump 9 operates continuously. However, not always the same amount of liquid is conveyed into the expansion vessel as flows out of it. In the heating phase of the heating fluid more liquid flows into the expansion vessel 4 than flows out of it. The water level 14 rises. In the cooling phase of the heating fluid, on the contrary, the water level 14 falls because more liquid is conveyed out of the expansion vessel 4 into the circulation system than flows in via the overflow valve 7.

Since a lower pressure prevails in the expansion vessel 4 than in the circulation system, namely practically atmospheric pressure, also a degassing of the heating fluid occurs. Air displaced as the water level 14 rises escapes in bubbles across the barrier liquid 17 in the siphon 16. If the water level 14 falls, air does indeed come into the expansion vessel 4 again from the outside, but at a "decelerated" rate due to the barrier liquid 17, thereby inhibiting the (re-)absorption of air or air components (e.g. oxygen) into the heating fluid.

As has been mentioned before, the shuttable solenoid valves 11 serve only to make the installation safe in case of malfunctions; they do not go into operation under normal operation of the heating installation.

In the embodiment example the use of a device according to the invention in a heating installation has been described. It could, however, be employed also in cooling systems, that is, wherever in a fluid circulation system pressure fluctuations occurring through volume changes of the circulation fluid are to be compensated.

I claim:

1. Device for expansion absorption in fluid circulation systems, in particular of heating or cooling installations, having at least one expansion vessel in gas exchange with the atmosphere, into which liquid from the fluid circulation system is received and from which liquid is returned to the fluid circulation system via a pressure pump, and in one conduit to the expansion vessel an overflow valve adjustable to the operating pressure of the installation is provided, a lower pressure prevailing in the expansion vessel than in the fluid circulation system, characterized in that the expansion vessel (4) is connected to the fluid circulation system via separate inflow and outflow conduits (5, 6) and that in the outflow conduit (6) from the expansion vessel (4) a continuously running forcing and circulating pump (9) is arranged.

2. Device according to claim 1, characterized in that at least in the inflow conduit (5), a valve controlled by a level regulator (13) of the expansion vessel (4), and designed as a solenoid valve (11), is arranged.

3. Device according to claim 1, characterized in that in the outflow conduit (6) a quantity regulating valve (10) is arranged in flow direction behind the forcing and circulating pump (9).

4. Device according to claim 1, characterized in that in the outflow conduit (6) of the circulating pump (9) a flowmeter (24) is connected downstream in flow direction.

5. Device according to claim 1, characterized in that the expansion vessel (4) has at the gas outlet (15) a siphon (16) which is filled with a barrier fluid (17).

6. Device according to claim 5, characterized in that both pipe legs of the siphon (16) have zones (16') of enlarged cross section.

7. Device according to one of claim 1, characterized by refill means (19 to 23) controlled via a level regulator (12) arranged in the expansion vessel (4).

8. Device according to claim 1, characterized in that at least one additional expansion vessel (18) is connected to the expansion vessel (4).

9. Device according to claim 1, characterized in that a partial stream of the system fluid is conducted via the inflow conduit (5), the expansion vessel (4), and the outflow conduit (6).

10. Device according to claim 1, characterized in that the entire fluid stream of the system fluid is conducted via the inflow conduit (5), the expansion vessel (4) and the outflow conduit (6).

11. Device according to claim 10, characterized in that the forcing and circulating pump (9) in the outflow conduit (6) is at the same time the system circulating pump.

12. An apparatus for accommodating expansion of fluid in a fluid circulation system, comprising:

an expansion vessel which is substantially at atmospheric pressure;

an inflow conduit connected between the circulation system and said expansion vessel for supplying fluid from the circulation system to said expansion vessel;

an outflow conduit connected between said expansion vessel and the circulation system for supplying fluid from said expansion vessel to the circulation system;

an overflow valve connected in said inflow conduit for passing fluid at a selected system pressure from the circulation system through said inflow conduit; and a continuously operating circulating pump connected in said outflow conduit for continuously pumping fluid from said expansion vessel to the circulation system at the selected system pressure;

whereby continuous operation of said circulating pump circulates fluid between said expansion vessel which is substantially at atmospheric pressure, and the circulation system which is at the selected system pressure while said expansion vessel contains a level of fluid which rises and falls to accommodate expansion of the fluid from the circulation system.

13. An apparatus according to claim 12 wherein the circulation system comprises heating means, radiating means, a forward flow conduit connected between said heating and radiating means for supplying fluid from said heating means to said radiating means and a return flow conduit connected between said radiating means and said heating means for returning fluid from said radiating means to said heating means, said inflow and outflow conduits being connected at spaced locations to one of said forward and return flow conduits.

14. An apparatus according to claim 13 wherein the circulation system includes a further circulating pump for circulating fluid through said forward and return flow conduits.

15. An apparatus according to claim 13 wherein one of said forward and return flow conduits connects said heating a radiating means only through said connected inflow conduit, expansion vessel and outflow conduit, said circulating pump operating to circulate fluid between said heating and radiating means.

16. An apparatus according to claim 12 including a gas exchange siphon connected to said expansion vessel for communicating said expansion vessel with the atmosphere, and a barrier fluid in said siphon for controlling the passage of gas through said siphon.

17. An apparatus according to claim 12 including at least one additional expansion vessel connected to said first mentioned expansion vessel for accommodating additional fluid expansion from the circulation system.

18. An apparatus according to claim 12 including a quantity regulating valve in said outflow conduit positioned between said circulating pump and the circulation system for regulating a quantity of fluid pumped by said circulating pump from said expansion vessel to said circulation system.

19. An apparatus according to claim 12 including level regulating means connected to said expansion vessel for sensing a level of fluid in said expansion vessel, and fluid supply means connected to said expansion vessel and operatively connected to said level regulating means for supplying fluid to said expansion vessel when a low level of fluid is sensed in said expansion vessel.

* * * * *